US006048415A

United States Patent [19]

Nakai et al.

[11] Patent Number: 6,048,415

[45] Date of Patent: Apr. 11, 2000

[54] HIGH STRENGTH HEAT TREATABLE 7000 SERIES ALUMINUM ALLOY OF EXCELLENT CORROSION RESISTANCE AND A METHOD OF PRODUCING THEREOF

[75] Inventors: Manabu Nakai; Takehiko Eto, both of Kobe, Japan

[73] Assignee: Kabushiki Kaisha Kobe Seiko Sho, Kobe, Japan

[21] Appl. No.: 09/055,906

[22] Filed: Apr. 7, 1998

[30] Foreign Application Priority Data

Apr. 18, 1997 [JP] Japan ..... 9-116522
Mar. 9, 1998 [JP] Japan ..... 10-076570

[51] Int. Cl.[7] ..... C22C 21/06

[52] U.S. Cl. ..... 148/417; 148/418; 148/419; 148/693

[58] Field of Search ..... 148/417, 418, 148/439, 693; 420/532

[56] References Cited

U.S. PATENT DOCUMENTS 3,856,584 12/1974 Cina ..... 148/159
5,221,377 6/1993 Hunt et al. ..... 148/417
5,759,302 6/1998 Nakai et al. ..... 148/415

FOREIGN PATENT DOCUMENTS 61-246341 11/1986 Japan .
62-202061 9/1987 Japan .
62-224654 10/1987 Japan .
63-125645 5/1988 Japan .

OTHER PUBLICATIONS

Di Russo, E.; Signoretti, S., Improvement of the Properties of High Strength Aluminum–Zinc–Magnesium–Copper Alloys by Thermomechanical Procedures, Agard Reg. (1973), Agard–R–610, 55–76.

*Primary Examiner*—Sikyin Ip
*Attorney, Agent, or Firm*—Oblon, Spivak, McClelland, Maier & Neustadt, P.C.

[57] ABSTRACT

A heat treatable 7000 series aluminum alloy has a micro-structure with a crystal grain size of 45 $\mu$m or less and an aspect ratio (longitudinal/long transverse ratio of crystal grain) of preferably 4 or less, whereby its corrosion resistance is improved outstandingly by applying a solution heat treatment and hardening and subsequently, applying an aging treatment at 100 to 145° C. for 5 to 50 hr, a reversion treatment at 140 to 195° C. for 0.5 to 30 hr. and a re-aging treatment at 100 to 145° C. for 5 to 50 hr. to thereby make an electroconductivity to 38–40 IACS %, and render the micro-structure so as to have a minimum distance for the $\eta$ phase on the crystal grain boundary of 20 nm or more and a maximum size for the $\eta'$ phase in the crystal grain of 20 nm or less.

10 Claims, No Drawings

HIGH STRENGTH HEAT TREATABLE 7000 SERIES ALUMINUM ALLOY OF EXCELLENT CORROSION RESISTANCE AND A METHOD OF PRODUCING THEREOF

BACKGROUND OF THE INVENTION

1. Field of the Invention

The present invention concerns a high strength heat treatable 7000 series aluminum alloy suitable to application uses such as usual machinery parts, general purpose products, and transportation equipments for aircrafts, railway vehicles and automobiles. The present invention particularly relates to a high strength heat treatable 7000 series aluminum alloy of excellent corrosion resistance.

2. Description of the Related Art

Heat treatable 7000 series aluminum alloys are precipitation type alloys capable of obtaining high strength by artificial aging after solution heat treatment and hardening and they are generally classified into Al-Zn-Mg-Cu series alloys and Al-Zn-Mg series alloys. Typically, Al-Zn-Mg-Cu series alloys include 7075(Al-5.5Zn-2.5Mg-1.6Cu-0.2Cr), 7050(Al-6.2Zn-2.3Mg-2.3Cu-0.12Zr), 7150(Al-6.4Zn-2.3Mg-2.3Cu-0.12Zr)and 7055(Al-8.0Zn-2.1Mg-2.3Cu-0.17Zr) and Al-Zn-Mg series alloys include 7003(Al-6.3Zn-0.8Mg-0.17Zr).

In a typical production method, slabs or billets manufactured by melt casting are applied with a homogenizing heat treatment and, in a case of extrusion products, for instance, re-heated and hot extruded, applied with a solution heat treatment in an air furnace or the like and then hardening and, optionally, applied with stretching as required. Subsequently, after working them into a shape of final products, they are controlled to a predetermined strength by an artificial aging. Further, also in a case of plate products, they are applied with a homogenizing heat treatment, hot rolling and, optionally, cold rolling and then solution heat treatment in an air furnace or salt bath furnace followed by hardening and, optionally, cold rolling or stretching. Subsequently, after being worked into final products, they are controlled to a predetermined strength by artificial aging. If the working degree is high, both of the extrusion material and plate materials are treated into soft materials in the course of the production steps (classifying mark O), worked into the shape of final products and then applied with a solution heat treatment and hardening In the heat treatable 7000 series aluminum alloy, the maximum strength is obtained by T6 treatment. In the heat treatable 7075 series aluminum alloy, typical heat treatment conditions according to JIS-W1103 and MIL-6088F are applied as a heat treatment at 120° C. for 24 hr. after applying the solution heat treatment and hardening. However, the corrosion resistance is deteriorated extremely. For example, in a test in accordance with ASTM-G47, SCC stress resistance (in the ST direction) is extremely lowered as 50 N/mm$^2$ or less. Further, in a test in accordance with ASTM-G34 (EXCO test), exfoliation corrosion resistance is extremely lowered as rank EC-ED.

In order to increase the corrosion resistance, an over-aging treatment collectively referred to in T7 refining is generally adopted. The SCC stress resistance is increased, for example, to 117–172, 242 and 289 N/mm$^2$ in T76 refining, T74 refining and T73 refining, respectively. Further, the layerous corrosion resistant property is also increased to the level of rank EB, rank EA and P. However, the strength is reduced remarkably, that is reduced by 15 to 30% relative to the strength of T6 refining. That is, they were used while reducing the strength in order to increase the corrosion resistance.

In view of the above, U.S. Pat. No. 3,856,584 proposes a heat treatment method aiming at high strength and high corrosion resistance together. The method is conducted by a three stage heat treatment after solution heat treatment and hardening, in which aging is applied in the first stage, the reversion is applied in the second stage and re-aging is applied in the third stage. Actual heat treatment conditions are as follows: Aging; at 120° C. for 24 hr. (T6 refining), reversion: at 200–260° C. for 7–120 sec, re-aging: at 115–1250° C. (for optional time). However, the reversion time is as short as 7 to 120 sec, and the heat treatment upon reversion treatment is also limited to a bath type heat treatment furnace such as an oil bath. Further, even if an oil bath corresponding to the size of products can be provided, the temperature elevation rate is slow for materials of large thickness and it is impossible to completely conduct appropriate reversion in such a short period of time.

Further, U.S. Pat. No. 5,221,377 also proposes this method. It is described for actual conditions of the heat treatment that aging and re-aging are applied at 120° C. for 24 hr, and reversion is applied at a temperature ranging from 182 to 236° C., which is kept for 5 min or more. This can attain a strength of 579 N/mm$^2$, which is higher by 10% than 7X50-T6. Further, the exfoliation corrosion resistance property corresponds to that of the rank EC-EB, which is comparable with 7X50-T76. However, the time for aging and re-aging treatment before and after reversion treatment are 24 hr. respectively and the total heat treatment time required for the three stage heat treatment is extremely as long as 50 hr. Further, corrosion resistance is around at such a level that the exfoliation corrosion resistant property corresponds to rank EC-EB, and SCC stress resistance is not even described. Still further, 7000 series aluminum alloy to be applied with this method are limited to those containing Zr as the transition element. Moreover, it is not even described and can not be recognized at all what microstructure can provide such properties.

As described above, the over-aging treatment such as T76, T74 and T73 has been known as the heat treatment for improving the corrosion resistance of 7000 series aluminum alloys. However, the strength is lowered remarkably. In view of the above, it has been proposed a three stage heat treatment comprising aging, reversion and re-aging after the solution heat treatment, and hardening as a heat treatment method of attaining high strength and high corrosion resistance simultaneously, but the reversion time is as short as several tens seconds, which is not industrially practical. Further, although it has been also intended to make the time for the reversion step longer, the exfoliation corrosion resistant property is still as low as about T76 treatment and it is quite unknown for the SCC resistant property. And still further, it has not yet been recognized at all what microstructure can provide the high strength and high corrosion resistance.

Demand for reducing the thickness and the weight has become increased more and more in recent years in application uses, for example, to transportation equipments such as aircrafts, railway vehicles and automobiles, and general machinery parts. Further, it has been also a strong demand for making those materials scarcely using aluminum alloys (particularly, 7000 series alloys) so far because of SCC worry with aluminum alloys, thereby reducing the weight and, at the same time, making all of the constituent materials with aluminum alloys, still more, improving the recycling performance. For example, aluminum bolts having high strength and high corrosion resistance have been demanded strongly. In view of the above, improvement regarding higher strength, particularly, higher corrosion resistance (SCC stress resistant and exfoliation-corrosion resistant properties) has been demanded for the 7000 series aluminum alloys.

SUMMARY OF THE INVENTION

It is an object of the present invention to provide a heat treatable 7000 series alloy in which corrosion resistance is outstandingly improved than that obtained by the existent method without lowering the strength and such properties can be obtained industrially easily.

For attaining the foregoing object, the present inventors have made an earnest study on a relationship between the micro-structure, and the strength and the corrosion resistance and, as a result, has found that the SCC resistant property and the exfoliation corrosion resistant property can be improved outstandingly by making the crystal grain size to 45 $\mu$m or less and, further, the exfoliation corrosion resistant property can be improved more by making the aspect ratio of the crystal grain (longitudinal/long transverse ratio of crystal grain) to 4 or less.

That is, the aluminum alloy of high strength and excellent corrosion resistance according to the present invention comprise a heat treatable 7000 series aluminum alloy in which the crystal grain size is 45 $\mu$m or less and, preferably, the aspect ratio is 4 or less.

In accordance with the present invention, difference in the orientation between each of adjacent crystal grains is reduced by refining crystal grains, so that, even when a tensile stress is applied, an effective tensile stress of separating grain boundaries is reduced. Therefore, a threshold stress of causing SCC is increased to improve SCC resistant property. If the crystal grain size is more than 45 $\mu$m such effects is insufficient. Further, when the aspect ratio is made 4 or less, the exfoliation corrosion resistance is improved. If corrosion should occur, it does not develop exceeding slight pitting. A preferred range for the crystal grain size is 30 $\mu$m or less.

In the present invention, a value (a) measured by a cutting method (according to JIS-H0501) in the direction of tensile stress which is applied to or remains in an aluminum alloy material as the value for the crystal grain size. The aspect ratio is represented as: (b)/(a) using a value (b) measured by a cutting method in a direction along which the highest evaluation is given to the crystal grain size, within a plane perpendicular to the direction of the tensile stress which is applied to or remains in the aluminum alloy material. For example, assuming that flat re-crystallized grains elongate in a rolling direction are formed in a rolled material, when a tensile stress is applied in the direction of the plate thickness (ST direction), the crystal grain size (a) is that along the ST direction and the crystal grain size (b) is that along the rolling direction (L direction) and the aspect ratio is: crystal grain size in the L direction/crystal grain size in the ST direction.

Further, when the heat treatable 7000 series aluminum alloy has a micro-structure in which the minimum distance for $\eta$ phase on the crystal grain boundary is 20 nm or more, and the maximum size for $\eta'$ phase in the crystal grain is 20 nm or less in addition to the crystal grain size and the aspect ratio described above, and has electroconductivity of 38–40 IACS %, strength, SCC resistant property and exfoliation corrosion resistant property are further improved.

DESCRIPTION OF THE PREFERRED EMBODIMENTS

Now, the heat treatable 7000 series aluminum alloy is a precipitation hardening type alloy and, when the alloy is put to artificial aging, for example, at 120° C. for 24 hr. after solution heat treatment and hardening, the strength is improved since a GP zone is finely precipitated in the grains. Further, the $\eta$ phase is continuously precipitated on the grain boundary. Since the $\eta$ phase is anodic and easily leached, the SCC stress resistant and exfoliation corrosion resistant properties are low. On the other hand, when the heat treatable 7000 series aluminum alloy is applied with over-aging as shown by classifying symbol T7 after solution heat treatment and hardening, since the GP zone in the crystal grain is precipitated to coarse $\eta'$ phase, with resultant that the strength is lowered. In addition, the $\eta$ phase on the crystal grain boundary is made coarser and discontinuous. Accordingly, corrosion resistance such as SCC stress resistant and exfoliation corrosion resistant properties is improved.

The three stage heat treatment method comprising aging, reversion and re-aging after solution heat treatment and hardening, with an aim of attaining high strength and high corrosion resistance simultaneously intends to realize a high strength by increasing the proportion of a GP zone as much as possible in the grain and a high corrosion resistance by extending the distance of the $\eta$ phase on the grain boundary as much as possible. The change of the micro-structure in the three stage heat treatment is considered as below. Namely, the GP zone in the grain caused by the aging after the solution heat treatment and hardening is re-solid solubilized by the reversion, but the GP zone is again precipitated by the subsequent re-aging. On the other hand, on the grain boundary, the $\eta$ phase caused by the aging is made coarser and discontinuous by the reversion and causes very little change by the subsequent re-aging.

The effect of improving the SCC resistant property and the exfoliation corrosion resistant property obtained by making the crystal grain size to 45 $\mu$m or less and preferably, making the aspect ratio to 4 or less in accordance with the present invention can be attained also with the material with classifying symbol T6. Further, remarkable improvement in the corrosion resistance is provided for the over-aged material represented by classifying symbol T7. Further, the corrosion resistance is improved outstandingly when the three stage heat treatment comprising the aging, reversion and re-aging is applied.

The three stage heat treatment according to the present invention applies aging at 100 to 145° C. for 5 to 30 hours, reversion at 140–195° C. for 0.5 to 30 hr. and re-aging at 100–145° C. for 5 to 50 hr. after solution heat treatment and hardening to the heat treatable 7000 series aluminum alloy, thereby providing a heat treatable 7000 series aluminum alloy having a micro-structure with the electroconductivity of 38–40 IACS %, the minimum distance for the $\eta$ phase on the crystal grain boundary of 20 nm or more and the maximum size for the $\eta'$ phase in the crystal grain of 20 nm or less, to thereby outstandingly improve the strength, the SCC resistant property and the exfoliation corrosion resistant property compared with those obtained by the existent three stage heat treatment method.

Then, reasons for defining the micro-structure $\eta'$ phase, $\eta$ phase) and heat treatment conditions will be explained below.

At first, if the minimum distance for the $\eta$ phase on the grain boundary is 20 nm or less, since each $\eta$ phase is leached continuously under a corrosive circumstance, the SCC stress resistant and exfoliation corrosion resistant properties are deteriorated. The GP zone contributes to the strength, and a high strength can be obtained by making the maximum size for the η' phase in the grain to 20 nm or less, within a range of the electroconductivity of 38 to 40 IACS %. For example, in such an aging state that the maximum size for the η' phase in the grain exceeds 20 nm, the GP zone to contribute to the strength is under precipitation to the η' phase even in a range of the electroconductivity from 38 to 40 IACS %. Therefore, the precipitation amount of the GP zone is decreased and no high strength can be obtained. In addition, since η' phase is partially under precipitation into the η phase in such an aging state, the precipitation amount of the GP zone is further decreased. On the other hand, in a region in which the electroconductivity exceeds 40 IACS %, the proportion of the η phase in the grain is in such an aging stage that the proportion of the η phase in the grain is increased remarkably and no high strength can be obtained. On the contrary, if the electroconductivity is less than 38 IACS %, since the η phase on the grain boundary is not made coarser, the distance of the η phase can not be extended, so that the corrosion resistance is reduced.

In the reversion, if the temperature is excessively high or the treatment time is too long even if the temperature is low, reversion of the GP zone proceeds, and the η phase and coarse η' phase, are precipitated so that it is difficult to obtain high strength even when the re-aging is applied subsequently. For preventing precipitation of the η phase and coarse η' phase in the reversion it is necessary to restrict the treatment time to 0.5 hr. or less if the temperature exceeds 195° C. Further, at a temperature lower than 140° C., the treatment time exceeds 30 hr. Both of the conditions are not practical with an industrial point of view. Accordingly, the condition for the reversion is defined as 140–195° C. for 0.5–30 hr. Among all, a condition at a temperature of 165 to 185° C. for 1 to 3 hr. can easily control the optimum precipitation state of the η phase and η' phase.

In the aging treatment, aging precipitation should not proceed till such a state that η phase and coarse η' phase are precipitated in the grains. If the aging precipitation proceeds to such a state, since the amount of the GP zone reversed upon reversion is decreased, the amount of the GP zone finally precipitated upon re-aging is decreased. Therefore, no sufficient strength can be obtained. On the contrary, if the aging is insufficient and the GP zone is precipitated only slightly, since the amount of the GP zone reversed in the reversion is decreased even if the succeeding reversion is applied in such a state, the GP zone precipitated finally upon re-aging is decreased. Therefore, no sufficient strength can be obtained. As described above, it is necessary upon re-aging to sufficiently precipitate the GP zone that is reversed upon reversion.

Then, if the aging temperature exceeds 145° C., the η phase and coarse η' phase tend to be deposited in a short period of time, and the amount of the GP zone is decreased by so much. Further, at a temperature lower than 100° C., a treating time in excess of 50 hr. is required for precipitating a sufficient amount of the GP zone. Accordingly, the aging condition is set as 100 to 145° C. for 5 to 50 hr. If the aging is conducted at a relatively high temperature of 130 to 145° C., a sufficient amount of GP zone tends to be deposited easily and the aging time can be shortened as 5 to 20 hours, which is industrially advantageous as well. Further, the η phase is precipitated with a more extended distance on the crystal grain boundary, compared with the case of aging at a temperature lower than 130° C. Such η phase is made coarser upon reversion after the aging treatment, and the distance of the η phase can be extended also upon completion of the reversion by extending the distance of the η phase already in the aging treatment.

Also in the re-aging treatment, the aging precipitation should not be proceeded till such a state in which the η phase and coarse η' phase are precipitated in the grains. If aging precipitation is proceeded to such a state, no high strength can be obtained naturally. On the contrary, if the aging treatment is insufficient and the GP zone is precipitated only slightly, no sufficient strength can be obtained naturally as well. Therefore, the condition for the re-aging is set as 100 to 145° C. for 5 to 50 hr. like that for the aging condition. Since the aging treatment is applied after solution heat treatment and hardening, the void concentration is high and solute atoms such as of Zn and Mg are easily diffused. On the other hand, since the re-aging is applied after the aging and the reversion, the void concentration is reduced and larger time is required compared with the aging treatment in order to diffuse Zn, Mg so as to obtain a high strength. Accordingly, it is more preferred that the re-aging is conducted under the condition, particularly, at 130 to 145° C. for 5 to 20 hr, among the condition at 100 to 145° C. for 5 to 50 hr.

It has been explained regarding the factors of the crystal grain size of the present invention that the corrosion resistance is improved outstandingly by combining them with the three stage heat treatment. That means specifically that following condition can be mentioned, as a preferred embodiment of an alloy according to the present invention: a heat treatable 7000 series aluminum alloy having a micro-structure in which the crystal grain size is 45 μm or less, an aspect ratio is preferably of 4 or less, the minimum distance for the η phase in the crystal grain boundary is 20 nm or more and the maximum size for the η phase in the crystal grains is 20 nm or less and having an electroconductivity of 38 to 40 IACS %.

Then, the heat treatable 7000 series aluminum alloy having the micro-structure as described above can be produced, for example, from a heat treatable 7000 series aluminum alloy, by applying homogenizing heat treatment and hot working, with optional subsequent cold working to prepare into products of predetermined size, then applying solution heat treatment and hardening, with optional subsequent cold working, and subsequent applying aging at 100 to 145° C. for 5 to 50 hr, reversion at 140 to 195° C. for 0.5 to 30 hr. and re-aging at 100 to 145° C. for 5 to 50 hr. Preferred conditions for the aging, reversion and re-aging are; 130–145° C.×5–20 hr, 165–185° C.×1–3 hr. and 130–145° C.×5–20 hr, respectively.

The three stage heat treatment comprising the aging, the reversion and re-aging is desirably conducted continuously with no intermediate cooling being intervened in the course of the aging, reversion and re-aging, such that by applying heating to a reversion temperature just after the end of the aging, and cooling to the re-aging temperature just after the end of the reversion.

Further, the present inventor, et al have found that it is necessary to strictly control the heating rate from the aging temperature to the reversion temperature to more than 20° C./hr. and less than 200° C./hr. and the cooling rate from the reversion temperature to the re-aging temperature to more than 20° C./hr, in order to obtain the micro-structure stably (the maximum size for the η' phase in the grain of 20 nm or less, the minimum distance for the η phase in the grain boundary of 20 nm or more). If the heating rate from the aging temperature to the reversion temperature is 20° C./hr. or less, since a great amount of the η phase is precipitated in the grain which is made coarser during reversion (precipitation distance for the η' phase is extended) before reaching the reversion temperature, no high strength can be obtained in the final product compared with the case of the micro-structure described above. Further, since precipitation of the η phase on the grain boundary proceeds, to narrow the precipitation distance for the η phase, no high corrosion resistance can be obtained compared with the case of the micro-structure described above. If the heating rate is 200° C./hr. or more, since a great amount of fine η' phase is precipitated around the GP zone as the nuclei during heating before reversion of the GP zone in the grain, which is made coarser at the reversion temperature (precipitation distance is widened), no high strength can be obtained in the final product compared with the case of the micro-structure described above. Further, if the cooling rate from the reversion temperature to the re-aging temperature is 20° C./hr. or less, the η' phase is made coarser (the precipitation distance is widened) in the course of cooling and no high strength can be obtained in the final product compared with the case of the micro-structure. As described above, it is essential to control the heating and cooling rates before and after the reversion within the ranges as described above in order to obtain the micro-structure and the high strength and high corrosion resistance in the final product.

The heating and cooling rates described above before and after the reversion can be attained also in an air furnace, and the micro-structure can be attained not only on the outer surface of structures but also to the inside of the structures also for the large scaled structures used, for example, in aircrafts.

The heating rate up to the aging and the cooling rate down to the re-aging are desirably at 20° C./hr. or more.

On the other hand, in a case of practicing the aging treatment, reversion treatment and the re-aging treatment independently, namely, when cooling is interposed between each of the treatments, it is desirable to set the heating rate from 50° C. to the reversion temperature after the aging to 20–200° C./hr, the cooling rate from the reversion temperature to 50° C. to 20° C./hr. or more and the heating and cooling rates for the aging and the reversion to 20° C./hr. or more.

The 7000 series aluminum alloy of the present invention comprises a composition, for example, containing Zn: 0.1–10 wt % and Mg: 0.1–5 wt %, and containing one or more of elements selected from the group consisting of Mn: 0.4–0.8 wt %, Cr: 0.15–0.3 wt %, Zr: 0.05–0.15 wt %, Sc: 0.01–0.5 wt % and Cu: 0.1–3 wt %, and the balance of Al and other impurities. If necessary, elements such as Ti, V, Hf may also be incorporated. The optional element has a function of refining a cast ingot structure and is restricted to 0.3 wt % or less with a view point of the degradation of the workability.

Zn, Mg, Cu are elements added in order to obtain a high strength and no effect can be obtained at 0.1 wt % or less. On the contrary, if the addition amount for each of Zn and Mg exceeds 10 wt % and 5 wt % respectively, the workability is remarkably deteriorated. If the addition amount of Cu exceeds 3 wt %, the corrosion resistance is remarkably deteriorated. Mn, Cr, Zr and Sc precipitate as dispersed particles mainly upon homogenizing heat treatment. The size distribution of the dispersed particles can be varied depending on the combination of the addition amount and the homogenizing heat treatment conditions, thereby the micro-structure can be varied as sub-crystal grain structure, fibrous structure and equi-axed crystal structure depending on the purpose of products. Particularly, such dispersed particles are indispensable inter metallic compounds in order to control the structure such that the crystal grain size is 30 μm or less and, further, the aspect ratio is preferably 4 or less as shown in the present invention. If the addition amount of them exceed 0.8 wt %, 0.3 wt %, 0.15 wt % and 0.5 wt %, respectively, the workability is greatly deteriorated. Further, if the addition amount of them are less than 0.4 wt %, 0.15 wt %, 0.05 wt % and 0.01 wt %, respectively, it is difficult to control the structure with the foregoing purpose.

Further, in order to improve the toughness and the fatigue property, this can naturally be obtained by controlling the inter-constituent distance and inter dispersed particle distance as disclosed in Japanese Patent Publication No. Hei 8-283892 (Title of the Invention: "Aluminum alloy of excellent destruction toughness, fatigue property and workability") filed by the present inventors.

The high strength heat treatment 7000 series aluminum alloy of excellent corrosion resistance according to the present invention is produced, for example, by applying homogenizing heat treatment and hot working to melt-cast slabs and billets according to a customary method, then applying the solution heat treatment and hardening and subsequently, applying the artificial aging treatment typically represented by JIS-W01103 and MIL-H-6088F. The artificial aging treatment is preferably conducted under the condition for the aging at 100 to 145° C. for 5 to 50 hr, for the reversion at 140 to 195° C. for 0.5 to 30 hr. and for the re-aging at 100 to 145° C. for 5 to 50 hr. Preferably the heating rate from the aging temperature to the reversion temperature is from 20° C./hr. to 200° C./hr, and the cooling rate from the reversion temperature to the re-aging temperature at 20° C./hr. or more. Depending on the shape and the size of the products, annealing and cold working (including warm working) are applied after hot working and cold working such as stretching is applied in accordance with necessity before artificial aging hardening after the solution heat treatment and hardening. In a case of applying the products according to the present invention to aircraft materials, it is particularly preferred to apply the solution heat treatment under the conditions of JIS-W-1103 and MIL-H-6088F. Any of air furnace (batch furnace), continuous annealing furnace, hot blower, oil bath or warm water bath may be used as a heat treatment furnace used in the present invention.

The size the shape of the recrystal grains can be controlled optionally by combination of the production steps (homogenizing, hot working, annealing, cold working (warm working), solution heat treatment). Therefore, it is difficult to define all production conditions for obtaining recrystal grains with the crystal grain size of 45 μm or less and, an aspect ratio preferably of 4 or less as shown in the present invention. For example, if when the conditions are defined based on the combination, for example, of the degree of cold working and solution treatment condition (temperature elevating rate, temperature keeping time) before solution heat treatment, the defined conditions fluctuate easily depending on, for example, homogenizing condition, hot working condition and annealing condition to make the definition useless. In summary, it is essential to make there crystal grain to45 μm or less and aspect ratio preferably to 4 or less in the final product. Typical production steps will be described in examples.

The present invention is applicable to heat treatable 7000 series aluminum alloys naturally irrespective of final shapes of materials such as plate materials, extruded materials, casting/forging materials and casting materials.

EXAMPLE

The present invention will be explained more specifically by way of examples.

Example 1

An aluminum alloy comprising 5.6 wt % of Zn, 2.5 wt % of Mg, 1.6 wt % of Cu, 0.2 wt % of Cr, 0.25 wt % of Fe, 0.20 wt % of Si and 0.06 wt % of Ti and the balance of impurities and aluminum was degassed to a hydrogen concentration in a molten alloy of 0.02 cc/100 ml Al and then melt cast into an ingot of 300 mm thickness. Then, after applying soaking at 450° C. for 24 hr, it was scraped to 250 mm thickness. It was reheated at 450° C. and hot rolled into a size of 30 to 60 mm thickness. Subsequently, after annealing at 400° C. for 8 hr. in an air furnace, it was cold rolled to 20 mm thickness. After applying intermediate annealing in an air furnace at 250 to 380° C. for 2 hr, it was applied with solution heat treatment in a salt furnace heated to 475° C. for 60 min, water hardened and subjected to 0.5% stretching. Successively, artificial aging was applied at 120° C.×24 hr. for five samples and artificial aging was applied by three stages under the condition of aging (135° C.×10 hr)→reversion (180° C.×1.5 hr)→re-aging (135° C.×10 hr) for one sample to prepare test specimens.

For each of the test specimens, form and electroconductivity of crystal grains, strength, SCC resistant and exfoliation corrosion resistant properties were examined in the following manner. Further, the maximum size for the η' phase in the grain and the minimum distance for the η phase in the grain boundary were examined for the test specimen applied with the three stage aging (example 4 of the invention) by the following manner. Production conditions and test results are shown in Table 1.

Form of Crystal Grains:

Crystal grain size (size) in the direction of the plate thickness (ST direction) was determined in accordance with a cutting method specified in JIS-H-0501, in a cross section perpendicular to the rolling direction. Further, the crystal grain size in the rolling direction, (L direction) was determined to calculate an aspect ratio (crystal grain size in L direction/crystal grain size in ST direction).

Electroconductivity:

In accordance with the electroconductivity measuring method of JIS-H0505.

Strength:

In accordance with a tensile test method JIS-Z2241 using JIS No. 5 test specimen sampled in the rolling direction.

SCC resistance:

In accordance with SCC resistance test in ASTM-G47. The direction of applying the tensile load is the ST direction (plate thickness direction).

Exfoliation corrosion resistant property:

In accordance with the exfoliation test ASTM-G34. Maximum size for η' phase in the grain;

Observed for 20 or more visual fields (visual fields: 5 cm×3.5 cm) at a magnification factor of 50,000 by TEM and the maximum size in all visual fields is shown. Minimum distance for η phase in the grain boundary:

Observed in the same manner in TEM, and minimum distance in all of visual fields is shown.

TABLE 1

| | Production condition, micro-structure and material property | | | | | | | | |
|---|---|---|---|---|---|---|---|---|---|
| | Production condition | | | | | Material property | | | |
| No. | Cold rolling ratio (%) | Intermediate annealing temperature | Form of recrystal grain Size | Form of recrystal grain Aspect ratio | Artificial aging condition (temp. × time) | Electroconductivity IACS % | Strength N/mm² | SCC stress resistant N/mm² | Exfoliation · corrosion resistant property: rank |
| 1 | 67 | 380 | 25 | 1.0 | 120° C. × 24 hr. | 33 | 455 | 150 | P~EA |
| 2 | 67 | 300 | 15 | 3.0 | 120° C. × 24 hr. | 33 | 445 | 100 | P |
| 3 | 67 | 330 | 10 | 3.5 | 120° C. × 24 hr. | 33 | 452 | 120 | P |
| 4 | 33 | 370 | 45 | 3.8 | 120° C. × 24 hr. | 33 | 445 | 110 | EB |
| 5 | 67 | 330 | 10 | 3.5 | ① | 39.5 | 600 | 300 | P |
| 6 | 50 | 250 | 50* | 12 | 120° C. × 24 hr. | 33 | 450 | <50 | EC~ED |

*Out of the definition of claims.

①: aging treatment (135° C. × 10 hr) → reversion treatment (180° C. × 1.5 hr) → re-aging treatment (135° C. × 10 hr) Maximum size for η' phase in the grain: 5 nm, minimum distance for the η phase in the grain boundary; 30 nm As can be seen from Table 1, Nos. 1–5 with the recrystal grain size of 45 μm or less have high SCC resistant property and exfoliation corrosion resistant property. Nos. 1–3, 5 having the grain size of 30 μm or less and the aspect ratio of 4 or less have particularly excellent property. Further, in No. 5 prepared by applying artificial aging for three stages and making the minimum distance for the η phase to 20 nm or more and the maximum size for the η' phase in the crystal grain 20 nm or less, the strength, SCC resistant property and the exfoliation corrosion resistant property are improved to extremely high levels.

Example 2

An aluminum alloy comprising 5.9 wt % of Zn, 2.3 wt % of Mg, 2.2 wt % of Cu, 0.12 wt % of Zr, 0.09 wt % of Fe, 0.08 wt % of Si and 0.06 wt % of Ti and the balance of impurities and aluminum was degassed to a hydrogen concentration in a molten alloy of 0.02 cc/100 ml Al and then melt cast into an ingot of 500 mm diameter. Then, after applying a soaking treatment at 450° C. for 24 hr, it was scraped to 480 mm diameter. Then, it was reheated at 450° C. and, afterhot extrusion into 20t×200w mm size, applied with a solution heat treatment in a salt bath heated to 475° C. for 60 min and applied with water hardening. Subsequently, three stage heat treatment shown in Table 2 was applied to prepare test specimens. Each of the test specimens had a crystal grain size of 30 μm and the aspect ratio of 3. The micro-structure, the material properties, etc. were examined for the test specimens like that in Example 1. The results are also shown together in Table 2.

TABLE 2

| Production condition, micro-structure and material property | | | | | | | | | | | |
|---|---|---|---|---|---|---|---|---|---|---|---|
| | 3 stage heat treatment | | | | | Micro-structure | | Material property | | | |
| | | Reversion condition | | | Re-aging | Maximum size of η | Minimum | | | | Exfoliation · corrosion |
| No. | Aging condition ° C. × hr. | Heating rate ° C. × hr. | temp × time ° C. × hr. | Cooling rate ° C./hr | condition temp. × time ° C. × hr. | phase in the grain nm | distance of η phase in the grain nm | Electro-conductivity IACS % | Strength N/mm² | SCC stress resistance N/mm² | resistant property rank |
| 7 | 130 × 10 | 80 | 180 × 1.5 | 80 | 130 × 10 | 3 | 40 | 39.5 | 620 | 300 | P |
| 8 | 130 × 12 | 160 | 180 × 1.5 | 120 | 130 × 12 | 5 | 45 | 39.8 | 630 | 290 | P |
| 9 | 135 × 6 | 30 | 170 × 3.0 | 40 | 135 × 8 | 5 | 35 | 39.8 | 620 | 280 | P |
| 10 | 120 × 24 | 15* | 190 × 0.8 | 15* | 120 × 24 | 25* | 15 | 41.5* | 530 | 150 | EB |
| 11 | 120 × 24 | 300* | 180 × 2.0 | 30 | 120 × 24 | 23* | 13 | 40.5* | 550 | 120 | EB |
| 12 | 120 × 24 | 80 | 170 × 3.0 | 10* | 120 × 24 | 22* | 10 | 41.5* | 550 | 100 | EB |

*Out of the definition of claims

As can be seen from Table 2, high strength, SCC resistant property and exfoliation corrosion resistant property can be obtained in any of the cases. Particularly, Nos. 7–9 prepared under the conditions for three stage heat treatment within preferred ranges including the heating/cooling rate can satisfy the definition of the present invention also with respect to the maximum size for the η' phase in the grain, the minimum distance for the η phase in the grain boundary and the electroconductivity and they are excellent regarding all the properties compared with Nos. 10–12 satisfying only the crystal grain size and the aspect ratio.

Example 3

An aluminum alloy comprising 5.9 wt % of Zn, 2.3 wt % of Mg, 2.2 wt % of Cu, 0.12 wt % of Zr, 0.09 wt % of Fe, 0.08 wt % of Si and 0.06 wt % of Ti and the balance of impurities and aluminum was degassed to a hydrogen concentration in a molten alloy of 0.02 cc/100 ml Al and then melt-cast into an ingot of 400 mm thickness. Then, after applying a soaking treatment at 450° C. for 24 hr, it was scraped to 380 mm thickness. It was reheated at 450° C. and hot rolled to a size of 80 mmt and 20 mmw, applied with a solution heat treatment in a salt bath furnace heated to 475° C. for 60 min and then water hardening. Subsequently, a 3 stage heat treatment as shown in Table 3 was conducted to prepare test specimens. The micro-structure, the material property, etc. were examined for the test specimen in the same manner as in Example 1. The results are collectively shown in Table 3.

TABLE 3

| Production condition, micro-structure and material property | | | | | | | | | | |
|---|---|---|---|---|---|---|---|---|---|---|
| | Production condition | Form of | | | Maximum | Minimum | Material property | | | |
| | Plate | recrystal grain | | 3 stage heat | size for η' | distance for η | Electro- | | SCC stress | Exfoliation · |
| No. | thickness of rolled material | Size μm | Aspect ratio | treatment (①, ②) | in the grain nm | phase in the grain nm | conductivity IACS % | Strength N/mm² | resistant N/mm² | corrosion resistant property: rank |
| 13 | 20 | 15 | 3 | ① | 4 | 45 | 39.5 | 630 | 320 | P |
| 14 | | | | ②* | 22* | 8* | 40.5 | 580 | 150 | EB |
| 15 | 80 | 60* | 12* | ②* | 30* | 5* | 40.3 | 500 | 70 | ED |

*Out of the definition of claims

①: aging treatment (130° C. × 10 hr) → heating (80° C./hr) → reversion treatment (180° C. × 1.5 hr) cooling (80° C./hr) re-aging treatment (135° C. × 10 hr)

②: aging treatment (120° C. × 24 hr) → heating (5° C./hr) → reversion treatment (170° C. × 3.0 hr) → cooling (5° C./hr) → re-aging treatment (120° C. × 24 hr)

As can be seen from Table 3, high strength, SCC resistant property and exfoliation -corrosion resistant property can be obtained in Nos. 13 and 14 capable of satisfying the definition of the present invention with respect to the crystal grain size and the aspect ratio. Particularly, No. 13 prepared under the conditions for the three stage heat treatment within preferred ranges including the heating/cooling rates can satisfy the definition of the present invention also with respect to the maximum size for the η' phase in the grain, the minimum distance for the η phase in the grain boundary and the electroconductivity and this is excellent regarding all the properties compared with No. 14 capable of satisfying only the crystal grain size and the aspect ratio.

According to the present invention, the strength and the corrosion resistance of the heat treatable 7000 series aluminum alloy can be improved further and the alloy can be produced industrially easily.

The entire disclosure of Japanese Patent Application Nos. 9-116522 filed on Apr. 18, 1997 and 10-76570 filed on Mar. 9, 1998 including specification, claims and summary are incorporated herein by reference in its entirety.

What is claimed is:

1. A high strength heat treatable 7000 series aluminum alloy consisting of crystal grains 45 μm or less in size, wherein a maximum size of an η' phase region in the crystal grains is 20 nm or less.

2. The aluminum alloy according to claim 1, wherein an aspect ratio (longitudinal/transverse) of the crystal grains of the aluminum alloy is 4 or less.

3. The aluminum alloy according to claim 1, wherein a minimum distance between η phase regions on a crystal grain boundary of the aluminum alloy is 20 nm or more, and the aluminum alloy has an electroconductivity of from 38 to 40 IACS %.

4. The aluminum alloy according to claim 2, wherein a minimum distance between η phase regions on a crystal grain boundary of the aluminum alloy is 20 nm or more, and the aluminum alloy has an electroconductivity of from 38 to 40 IACS %.

5. A method of producing a high strength heat treatable 7000 series aluminum alloy, the method comprising subjecting a heat treatable 7000 series aluminum alloy, which was previously subjected to a homogenizing heat treatment and hot working with subsequent optional cold working followed by solution heat treatment and hardening with optional subsequent cold working, to an aging treatment at an aging temperature of 100 to 145° C. for 5 to 50 hours;

then subjecting the alloy to a hardening reversion treatment at a reversion temperature of 140 to 195° C. for 0.5 to 30 hours;

then subjecting the alloy to a re-aging treatment at a re-aging temperature of 100 to 145° C. for 5 to 50 hours; and forming the aluminum alloy of claim 1.

6. The method according to claim 5, wherein a heating rate from the aging temperature to the reversion temperature is from 20° C./hr to 200° C./hr; and a cooling rate from the reversion temperature to the re-aging temperature is 20° C./hr or more.

7. The aluminum alloy according to claim 1, consisting of crystal grains 30 μm or less in size.

8. The method according to claim 5, wherein the aging treatment is at a temperature of 130 to 145° C. for 5 to 20 hours.

9. The method according to claim 5, wherein the reversion treatment is at a temperature of from 165 to 185° C. for 1 to 3 hours.

10. The method according to claim 5, wherein the re-aging treatment is at a temperature of 130 to 145° C. for 5 to 20 hours.

* * * * *